United States Patent [19]

DeNardo et al.

[11] Patent Number: 4,568,049

[45] Date of Patent: Feb. 4, 1986

[54] MINING IMPLEMENT SUPPORT FOR A GOLD PAN

[76] Inventors: Robert M. DeNardo; Sandra G. DeNardo, both of 6776 E. Gage Ave., Bell Gardens, Calif. 90201

[21] Appl. No.: 572,918

[22] Filed: Jan. 23, 1984

[51] Int. Cl.[4] ..... A47G 21/14

[52] U.S. Cl. ..... 248/205.1; 248/37.6

[58] Field of Search ..... 248/37.6, 210, 37.3, 248/205.1, 231.8; 312/351

[56] References Cited

U.S. PATENT DOCUMENTS

| | | | |
|---|---|---|---|
| 1,327,437 | 1/1920 | Lewis | 248/37.6 |
| 2,194,417 | 3/1940 | Bowes | 248/37.3 |
| 2,590,286 | 3/1952 | Wirtanen | 248/37.6 |
| 2,919,086 | 12/1959 | McMahan | 248/37.6 |
| 3,163,385 | 12/1964 | Lazan | 248/37.6 |
| 4,266,746 | 5/1981 | Klaiber | 248/210 |

FOREIGN PATENT DOCUMENTS

| | | | |
|---|---|---|---|
| 145765 | 11/1903 | Fed. Rep. of Germany | 248/37.6 |

*Primary Examiner*—Reinaldo P. Machado
*Assistant Examiner*—Alvin Chin-Shue

[57] ABSTRACT

A mining implement support for supporting one or more items on a pan for panning gold has a Vee shaped body made of rigid sheet material. One member of the Vee being the shorter is disposed substantially vertical while the other longer member is disposed on an incline. To the top of the inclined member is fixed a clip which opens near the bottom or bight portion of the Vee body. The vertical member of the body has a pair of arms extending outwardly therefrom. From a region near the outward edge of each arm to a region near the center of the vertical member is stretched a resilient line. Another resilient line is stretched across the inclined member so that this line is anchored in three places to the member, near the edges and at the center thereof. Mining implements of various forms can be readily supported by nesting them between the respective resilient lines and the body portion.

5 Claims, 4 Drawing Figures

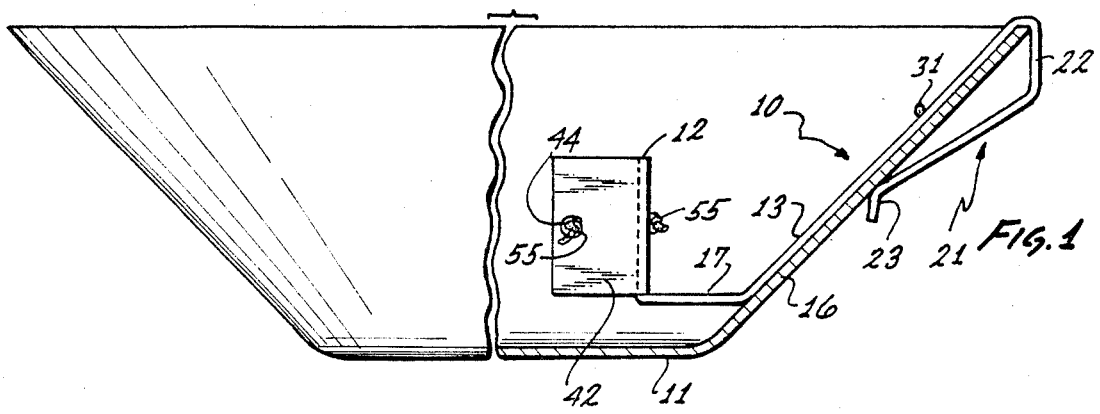
FIG. 1
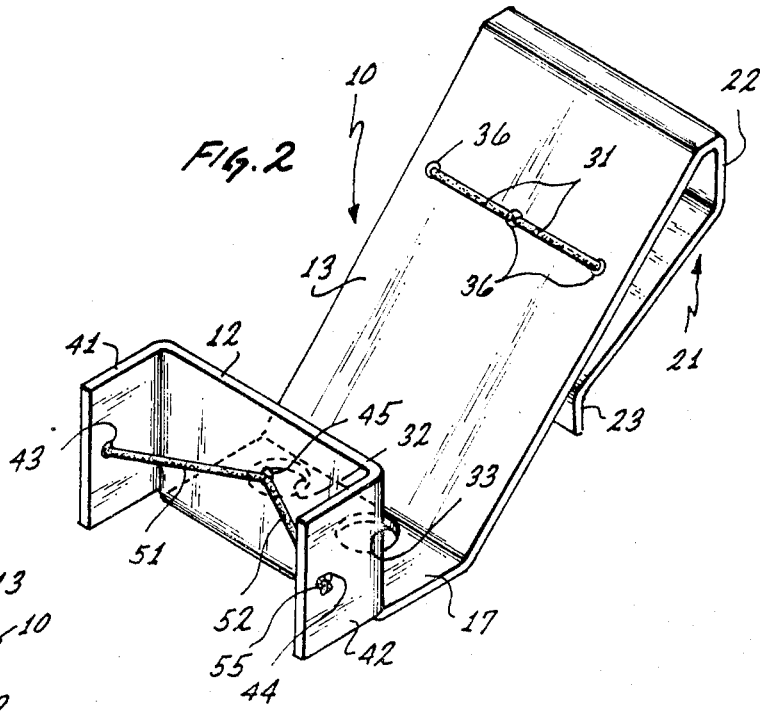
FIG. 2
FIG. 3
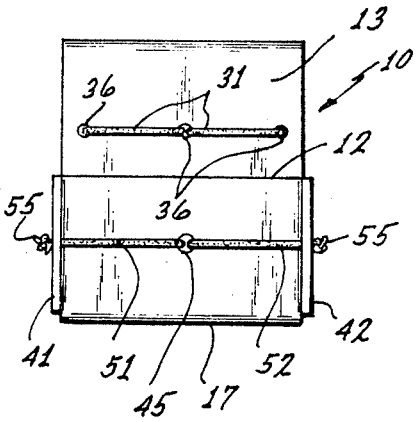
FIG. 4
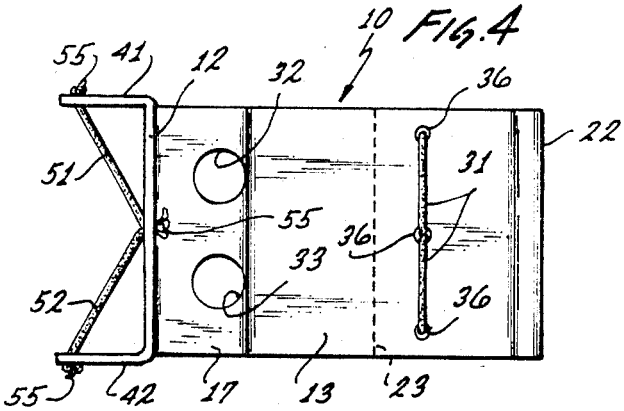

MINING IMPLEMENT SUPPORT FOR A GOLD PAN

FIELD OF THE INVENTION

This invention relates to the field of supports and, in particular, relates to a support which is releaseably attachable to a pan with sloping sides and which can support elongated items in a vertical postiion.

BACKGROUND OF THE INVENTION

Supports that are releaseably attachable to a container have been disclosed in a number of U.S. patents. Some of these U.S. Patents are U.S. Pat. Nos. 4,100,657; 3,163,385; 2,906,124; 2,713,469; and 556,200. Although the supports disclosed in these patents perform the task for which they were designed, they are limited in use in that they can not be used in conjunction with a container with a sloping or conical shaped wall and still allow the items they were designed to support to be disposed in a substantially vertical position.

An example, where these prior art supports have little or no utility, is with a container such as a gold washing pan. Gold washing pans, in general, have a flat bottom and an outwardly sloping wall attached to the bottom. The angle which the sloping wall makes with the bottom is about 45°. When one pans for gold he usually carries with him one or more test tube type vials which are elongated cylindrical glass containers about one half inch in diameter. Also, one should have a tweezer and an "artist" brush. The purpose of the tweezer is to allow one to pick up the relatively larger particles; the purpose of the brush is to separate the particles so the sand can be more readily washed from the gold dust; and the purpose of the vials is to store the gold dust and nuggets.

Up to now when one pans for gold these items, i.e., vial, tweezer and brush, are placed in one's shirt pocket if he has one or else he has to make other arrangements. One can readily observe that, if the weather is hot and one is in shorts, no pockets are available and these items are usually set down away from the panning operation.

SUMMARY OF THE INVENTION

The preferred embodiment is made of sheet metal which has spring-like qualities. The support has a Vee shaped body formed like a dilateral angle wherein the angle matches the angle of the sloping wall of the container. The longer member of the dilateral angle is formed into a clip by bending it around 180° to form a bight so that the free edge bears on and is against the longer member of the body. The other or shorter member of the body has preferably a pair of arms extending outwardly therefrom. Then stretched between ech arm and the shorter member is a line made of a resilient material so that two vials can be supported vertically. Also disposed across the longer member is another line made of resilient material so that the tweezer and brush can be supported.

OBJECTS OF THE INVENTION

An object of this invention is to provide a support which can be releasably attached to a container with a conical wall and which can hold items in a vertical position.

Another object of the invention is to provide a support made of rigid sheet material with resilient lines attached thereto so that items can be held therebetween.

These and other objects and features of advantages will become more apparent after one studies the following preferred embodiment of the invention together with the appended drawing.

BRIEF DESCRIPTION OF THE DRAWING

FIG. 1 shows a standard pan for panning gold, in partial section and laterally condensed, with our novel implement support mounted thereto and shown in side view.

FIG. 2 is a pictorial view of our novel implement support removed from the pan.

FIG. 3 is a front elevation of our novel support.

FIG. 4 is a plan view of our novel support.

DETAILED DESCRIPTION OF THE DRAWING

With reference being made first to FIG. 2, one sees that our novel basic support is fashioned from a single blank of bendable sheet material wherein the component portions are possessed of the desired strength and resiliency to accomplish the end result. The support has a body portion 10 which, when the support is mounted on a standard gold pan 11 (FIG. 1), is disposed within the boundaries of the pan 11 as shown in FIG. 1. The body 10 is shaped as a Vee having a short member 12 disposed almost vertically and a long member 13 disposed at about a 45° angle or the same angle as the angle of the sloping wall 16 on the pan 11. For reasons that will become apparent hereinafter, the apex or bight of the Vee is formed rather bluntly and is shown by a flat member 17. To firmly hold our novel support 10 to the pan 11, we have formed a retaining clasp 21 which is integral to the upper end of the long member 13. The clasp 21 is fashioned into a hook 22 which may be suitably positioned in the manner shown in FIG. 1. The lower end of the hook 22 is fashioned into a return bend 23 which is convexly rounded so that the support 10 can be clamped to the sloping wall 16 of the gold pan 11 with the bend 23 bearing against the exterior surface and the long member 13 bearing against the interior surface of the gold pan.

Since the function of the support is to hold multiple items such as test tubes, brush and tweezers (not shown) we have found that the brush and tweezers can readily be held against the long member 13 by providing a resilient line 31 stretched across the member 13 at or near its top. To further hold the implements in place we have provided, for example, a pair of holes 32 and 33 in member 17 whereby a respective implement may have one end protruding therethrough. Also, the preferred means for holding line 31 in place is provided by three holes 36 transversely disposed and formed in long member 13. The line 31 is suitably threaded through each hole 36 and a retaining knot (not shown) is formed at each hole 36 on the side of the member 13 which is adjacent the pan 11.

Since test tubes are relatively blunt and somewhat difficult to insert under a resilient line which is stretched against a surface such as line 31 is disposed against member 13, we have developed a different feature so that test tubes or vials can be supported. To both outer edges of the short vertical member 12 we have formed a pair of outwardly extending arms 41 and 42 which are perpendicular to member 12. Then we have formed a hole 43 near the free end of arm 41 and spaced from member 12 and formed another hole 44 near the free end of arm 42 and also spaced from member 12. Then at a region about midway between the arms 41 and 42 and in member 12 we have formed another hole 45. This allows us to stretch a resilient line 51 from hole 43 to hole 45 and another resilient line 52 from hole 44 to hole 45, thereby providing a triangular opening between the respective line and member 12 and arms 41 and 42. One skilled in the art can use suitable means such as knots 55 to anchor the lines 51, 52 and 31 within the respective holes.

Having described the preferred embodiment of the invention one skilled in the art after studying the above description could devise other embodiments without departing from the spirit of our invention. Therefore our invention is not limited to the embodiment described but includes all embodiments coming within the scope of the claims.

We claim:

1. A support for attachment to a utensil such as a pan for panning gold, these pans are round or rectangular in shape with a flat bottom and sides which slope outwardly and upwardly at approximately a 45 degree angle, and for holding implements, said support comprising:

a body formed of rigid sheet material;

said body having a first member attached to a second member to form a substantially dihedral angle so that said body has a substantially Vee shape in edge elevation;

a clip attached to said second member so that said utensil is capable of being disposed between said second member and said clip;

said first member has a pair of arms extending outwardly therefrom;

said first line is disposed from at least one of said arms to said first member so that a space is formed between said line and said first member.

2. The support of claim 1 wherein:

the dihedral angle between said first and second member is more than 30°.

3. The support of claim 2 wherein:

a second resilient line is attached to said second member.

4. The support of claim 3 wherein:

said second member has at least one hole formed therein and disposed on a transverse line;

said second line is suitably attached to the second member through said hole formed therein.

5. The support of claim 3 wherein:

said body has a flat member joining said first and second member so that said dihedral angle is blunt;

at least one hole is formed in said flat member so that one of said implements is capable of being disposed therein.

* * * * *